US011734996B2

(12) United States Patent
Bochsler et al.

(10) Patent No.: US 11,734,996 B2
(45) **Date of Patent: *Aug. 22, 2023**

(54) SYSTEM AND METHODS FOR DOWNLOADING PRODUCTION ORDER SPECIFIC SOFTWARE AND FIRMWARE TO AN ELECTRONIC GAMING MACHINE DEVICE

(71) Applicant: IGT, Las Vegas, NV (US)

(72) Inventors: David Bochsler, Reno, NV (US); Xuedong Chen, Reno, NV (US); Josh Scotto, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/451,230

(22) Filed: Oct. 18, 2021

(65) Prior Publication Data

US 2022/0036695 A1 Feb. 3, 2022

Related U.S. Application Data

(63) Continuation of application No. 16/534,740, filed on Aug. 7, 2019, now Pat. No. 11,176,775.

(51) Int. Cl.
*G07F 17/32* (2006.01)

(52) U.S. Cl.
CPC ..... *G07F 17/3227* (2013.01); *G07F 17/3223* (2013.01); *G07F 17/3225* (2013.01); *G07F 17/3232* (2013.01)

(58) Field of Classification Search
CPC ..... G07F 17/3223; G07F 17/3227
See application file for complete search history.

(56) References Cited

U.S. PATENT DOCUMENTS

| | | | | |
|---|---|---|---|---|
| 4,335,809 | A | 6/1982 | Wain | |
| 4,558,413 | A | 12/1985 | Schmidt et al. | |
| 5,954,583 | A * | 9/1999 | Green | G07C 9/257 463/29 |
| 6,006,034 | A | 12/1999 | Heath et al. | |
| 6,219,836 | B1 | 4/2001 | Wells et al. | |
| 6,411,941 | B1 | 6/2002 | Mullor et al. | |
| 6,533,659 | B2 | 3/2003 | Seymour et al. | |
| 6,804,763 | B1 * | 10/2004 | Stockdale | G07F 17/32 463/43 |
| 7,399,229 | B2 | 7/2008 | Rowe | |
| 7,641,555 | B2 * | 1/2010 | McKinley | G07F 17/3234 463/43 |
| 7,785,204 | B2 | 8/2010 | Wells et al. | |
| 7,841,941 | B2 | 11/2010 | Sharpless et al. | |
| 7,972,214 | B2 | 7/2011 | Kinsley et al. | |
| 8,308,557 | B2 | 11/2012 | Bryson et al. | |
| 8,337,301 | B2 | 12/2012 | Topham et al. | |
| 8,340,717 | B2 | 12/2012 | Ahlin | |
| 8,347,280 | B2 * | 1/2013 | Swarna | G07F 17/323 717/169 |
| 8,388,448 | B2 | 3/2013 | Kinsley et al. | |
| 8,622,822 | B2 | 1/2014 | Tanimura | |
| 8,667,086 | B2 | 3/2014 | Sun et al. | |
| 8,721,446 | B2 | 5/2014 | Lee et al. | |

(Continued)

*Primary Examiner* — Steven J Hylinski
(74) *Attorney, Agent, or Firm* — Neal, Gerber & Eisenberg LLP

(57) ABSTRACT

A system and method for downloading production order specific software and/or firmware to an electronic gaming machine device is disclosed.

20 Claims, 7 Drawing Sheets

(56) References Cited

U.S. PATENT DOCUMENTS 8,827,802 B2 * 9/2014 McCoull ..... G06F 21/123 463/16
9,135,777 B2 9/2015 Hamlin et al.
9,147,315 B2 9/2015 Gatto et al.
9,158,531 B2 10/2015 Lin
9,251,647 B2 * 2/2016 Nelson ..... G07F 17/3223
9,508,218 B2 11/2016 Ruppert
9,604,138 B2 3/2017 Topham et al.
11,176,775 B1 * 11/2021 Bochsler ..... G07F 17/3241
2001/0046894 A1 * 11/2001 Lemay ..... G07F 17/3216 463/29
2002/0116615 A1 8/2002 Nguyen et al.
2002/0137217 A1 9/2002 Rowe
2002/0138594 A1 9/2002 Rowe
2003/0216182 A1 * 11/2003 Gauselmann ..... G07F 17/323 463/40
2003/0228912 A1 * 12/2003 Wells ..... G07F 17/323 463/43
2004/0180721 A1 9/2004 Rowe
2004/0248642 A1 * 12/2004 Rothschild ..... G07F 17/323 463/20
2004/0254013 A1 * 12/2004 Quraishi ..... G07F 17/3202 463/29
2005/0192099 A1 * 9/2005 Nguyen ..... G07F 17/3232 463/42
2005/0209005 A1 9/2005 Acres et al.
2005/0223219 A1 * 10/2005 Gatto ..... H04L 9/006 713/191
2005/0282637 A1 * 12/2005 Gatto ..... A63F 13/12 463/42
2005/0282638 A1 12/2005 Rowe
2006/0035713 A1 2/2006 Cockerille et al.
2006/0046819 A1 * 3/2006 Nguyen ..... G07F 17/323 463/16
2006/0160622 A1 * 7/2006 Lee ..... G07F 17/3241 463/25
2007/0032288 A1 2/2007 Nelson et al.
2008/0162729 A1 7/2008 Ruppert
2009/0124392 A1 * 5/2009 Ruppert ..... G07F 17/3227 463/42
2009/0247301 A1 10/2009 Hamlin et al.
2010/0217992 A1 * 8/2010 Hamlin ..... G06F 21/725 726/20
2014/0087863 A1 * 3/2014 Shimabukuro ..... G07F 17/3241 463/29

* cited by examiner

1000

SYSTEM AND METHODS FOR DOWNLOADING PRODUCTION ORDER SPECIFIC SOFTWARE AND FIRMWARE TO AN ELECTRONIC GAMING MACHINE DEVICE

PRIORITY

This application is a continuation of, claims priority to and the benefit of U.S. Non-Provisional patent application Ser. No. 16/534,740, filed on Aug. 7, 2019, the entire contents of which are incorporated herein by reference.

BACKGROUND

The present disclosure relates to system and methods for downloading production order specific software and firmware to an electronic gaming machine device.

BRIEF SUMMARY

Various embodiments of the present disclosure provide a system for downloading electronic gaming machine program files to an electronic gaming machine device, and wherein the system includes a release server configured to store the electronic gaming machine program files including one of software and firmware. The system includes a macroscheduler server configured to (1) determine an active production order, (2) verify that a set of the electronic gaming machine program files corresponding to the active production order exist on the release server, (3) verify that the set of electronic gaming machine program files meet jurisdictional requirements corresponding to the active production order, and (4) generate a production order tasklist file including a list of the set of electronic gaming machine program files and corresponding file path. The system also includes a production order tasklist server configured to store the production order tasklist file. The system further includes a production network download client tool configured to (1) connect to the electronic gaming machine device, and (2) enable the electronic gaming machine device to (a) access the production order tasklist file stored on the production order tasklist server, (b) download the set of electronic gaming machine program files corresponding to the active production order, and (c) install the downloaded electronic gaming machine program files.

Various embodiments of the present disclosure provide a method for downloading electronic gaming machine program files to an electronic gaming machine device and which includes inserting a production network download client tool into the electronic gaming machine. The method includes using the production network download client tool to access a production order tasklist server to retrieve a production order tasklist file corresponding to an active production order associated with the electronic gaming machine device. The method further includes determining a set of electronic gaming machine program files to be downloaded to the electronic gaming machine based on the production order tasklist file, the electronic gaming machine program files including one of software and firmware. The method further includes determining a file path of the set of electronic gaming machine program files, accessing the set of electronic gaming machine program files based on the determined file path, downloading the set of electronic gaming machine program files, and installing the set of electronic gaming machine program files.

Additional features are described in, and will be apparent from, the following Detailed Description and the figures.

DETAILED DESCRIPTION

Production Network Download Process Example Embodiments

In various embodiments, the present disclosure relates generally to systems and methods that enable efficient and secure downloading of production order specific software and firmware to an electronic gaming machine device ("EGM device"). Known systems and methods employ the use of one or more USB flash drives to store production order specific software and firmware. In such known systems and methods, one or more of the USB flash drives are loaded with the software and firmware, and then physically inserted into the EGM device for downloading such software and firmware onto the EGM device. The present disclosure provides faster, more secure, and more streamlined downloading of software and firmware to EGM devices. The present disclosure also eliminates the need for certain physical steps in these known systems and methods, thus providing a technical improvement of over such known systems and methods.

More specifically, in various embodiments of the present disclosure, the gaming system is configured to simplify the process of downloading software and/or firmware to EGM devices. In particular, certain embodiments of the present disclosure enable software and/or firmware to be wirelessly downloaded to the EGM device from a secure server without the use of any USB flash drives. This enables modifications and changes to the software and/or firmware to be made remotely, and for those modifications and changes to be downloaded to the EGM device with a very short lead time. Elimination of the use of the USB flash drives (used during the known methods to temporarily store the software and/or firmware updates) streamlines the process of downloading software and/or firmware to EGM devices, reduces labor required, mitigates various risks of misplaced USB drives or damaged USB drives, reduces the possibility of human error (which can occur and cause an incorrect USB drive to be used with an EGM device), and provides a more secure and efficient system and method.

In this disclosure, the systems and methods are described particularly in the context of downloading program files to an EGM device. An EGM device can include an EGM itself, a processing unit of an EGM (e.g., an advanced video platform (AVP) box), and/or various peripheral devices of an EGM, including for example a bill validator, printer, light controller, card controller, reel controller, or other various downloadable controllers. As such, it should be appreciated that the use of "EGM device" throughout this disclosure may refer to any of these devices or components.

Figure 1:
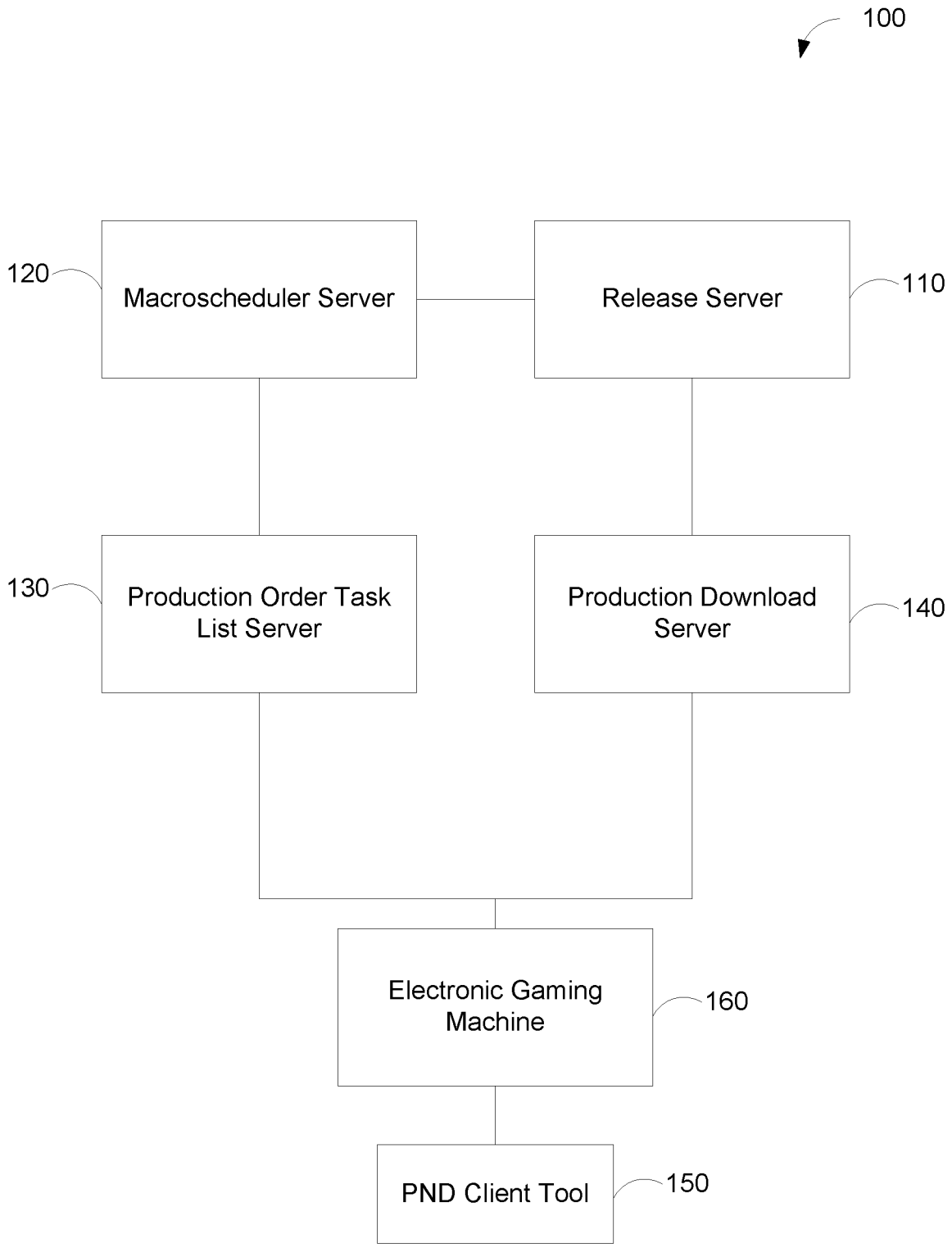
FIG. 1 is a block diagram of an example embodiment of a system of the present disclosure, and which is configured to implement various example methods of the present disclosure.

FIG. 1 is a simplified block diagram of an example system 100 of the present disclosure. The system 100 includes: (1) a release server 110; (2) a macroscheduler server 120; (3) a production order tasklist server 130; (4) a production download server 140; (5) a production network download ("PND") client tool 150; and (6) an electronic gaming machine device or EGM device 160. It should be appreciated that two or more of the servers may be included in the same physical device (e.g., computing device) in accordance with the present disclosure. For instance, two or more of the servers 110, 120, 130, and 140 may share a memory and/or processor. Alternatively, some or all of the servers 110, 120, 130, and 140 and the EGM device 160 may be physically separate and communicatively coupled via wired or wireless communication paths (not labeled).

It should be appreciated that each of the release server 110, the macroscheduler server 120, the production order tasklist server 130, and the production download server 140 may be any suitable computing device or devices, including: (1) a processor, (2) a memory, and (3) a communication interface, in accordance with the present disclosure.

For each such device, the processor can be any suitable processing device or set of processing devices, such as a microprocessor, a microcontroller-based platform, a suitable integrated circuit, or one or more application-specific integrated circuits (ASICs), configured carry out the various functions described herein.

For each such device, the memory can include: (1) volatile memory (e.g., RAM, which can include non-volatile RAM, magnetic RAM, ferroelectric RAM, and any other suitable forms); (2) non-volatile memory (e.g., disk memory, FLASH memory, EPROMs, EEPROMs, memristor-based non-volatile solid-state memory, etc.); (3) unalterable memory (e.g., EPROMs); (4) read-only memory; and/or (5) a secondary memory storage device, such as a non-volatile memory device, configured to store various information described herein (e.g., program files, production orders, jurisdictional requirements, tasklist files, etc.). In certain embodiments, the memory resides within the housing of the one or more of the servers 110, 120, 130 and 140, while in other embodiments at least one component of the memory resides outside of the housing of the one or more of the servers 110, 120, 130, and 140. In these embodiments, any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

For each such device, the communication interface can include one or more components that enable wired or wireless communication via one or more communication protocols. Example communication protocols can include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc.

Referring back to FIG. 1 and the system 100, the example release server 110 is now further described. The release server 110 stores electronic gaming machine program files (referred to herein as "program files"). The program files are configured to be downloaded to and installed on an EGM device. The program files can include computerized instructions for controlling any games (such as any primary or base games and/or any secondary or bonus games) displayed by the EGM device. Additionally, the program files can include computerized instructions in the form of software and/or firmware for operating the EGM device and its various components (such as but not limited to one or more input devices, display devices, sound producing devices, etc.). This can include both initial computerized instructions (e.g., for a newly produced EGM device), as well as updates to computerized instructions currently in use (e.g., for a currently in use EGM device). The program files stored by the release server 110 can be currently in development or finalized versions. The finalized versions are those that have been vetted and approved for use in an EGM device. Each program file has a corresponding file path on the release server 110.

In some examples, the release server 110 may be communicatively coupled to an update developer computing device (not shown) that is usable by a developer to generate, create, or otherwise develop various program files. The developer may access the release server 110 via the update developer computing device to transmit the program files to the release server 110 for storage and use in the system and method of the present disclosure.

The example macroscheduler server 120 is configured to perform various functions, including: (1) determining an active production order; (2) verifying that program files corresponding to the active production order exists on the release server; (3) verifying that the program files corresponding to the active production order meet the appropriate jurisdictional requirements corresponding to the active production order; and (4) generating a production order tasklist file based on (1), (2), and (3).

Regarding function (1), the macroscheduler server 120 is configured to determine an active production order. A production order includes a specific EGM device and a list of program files that should be downloaded and installed on the EGM device. The production order can also include various other information, such as the corresponding jurisdiction (and/or jurisdictional requirements for program files used in the jurisdiction), business or entity that purchased the EGM device, and the like. Active production orders can refer to those production orders that are scheduled or intended to be completed (but not yet scheduled). An operator may convert a production order from inactive to active to indicate that the production order should be executed. Inactive production orders can refer to those production orders that are not yet approved, are not intended to be executed, or are already completed.

Regarding function (2), the macroscheduler server 120 is configured to verify that program files corresponding to the active production order exist on the release server 110. This includes transmitting and receiving information with the release server 110. In some examples, this can include transmitting a query to the release server 110 to determine whether the program files corresponding to the active production order are located at their corresponding file paths.

Regarding function (3), the macroscheduler server 120 is configured to verify that the program files corresponding to the active production order meet jurisdictional requirements corresponding to the active production order. Jurisdictional requirements refer to rules, regulations, and procedures for operation of an EGM device (and the corresponding program files) in a given jurisdiction. Each county, state, country, and other jurisdictional area can have different requirements for the program files (e.g., software and/or firmware) running on an EGM device present within its boundary. For example, a first jurisdiction may require that certain security features be included in the program files, while a second jurisdiction does not. Because a given program file (e.g., an electronic game file) can be included on EGM devices operating in multiple different jurisdictions, the macroscheduler server 120 is configured to verify that the program file meets the jurisdictional requirements of the jurisdiction corresponding to the active production order. If an EGM device corresponding to the active production order is scheduled to be operated in Las Vegas, Nev., the macroscheduler server 120 verifies that the program files corresponding to the active production order meet the jurisdictional requirements of Las Vegas, Nev. In some examples, the macroscheduler server 120 also verifies that program files corresponding to inactive production orders meet the corresponding jurisdictional requirements of the jurisdictions corresponding to the inactive production orders. This enables the macroscheduler server 120 to continuously monitor program files and production orders to provide a preemptive check, ensuring that the program files for a given production order meet the most up to date jurisdictional requirements.

Regarding function (4), the macroscheduler server 120 is configured to generate a production order tasklist file. The production order tasklist file can be generated based on function (1), (2), and (3). For example, the macroscheduler server 120 may generate the production order tasklist file only after completion of functions (1), (2), and (3). The production order tasklist file includes a list of the set of program files corresponding to the active production order, along with the specific network path or paths of the set of program files on the release server. Each network path can be an FTP network path that is used to access and download the program file. The generated production order tasklist file is then transmitted to the production order tasklist server 130. While the present disclosure indicates that the macroscheduler server "generates" a production order tasklist file, it should be appreciated that the macroscheduler server 120 may alternatively select a production order tasklist file from a list, partially generate the production order tasklist file, or otherwise create, produce, or select an appropriate production order tasklist file.

In certain example embodiments, the macroscheduler server 120 is configured to perform one or more of functions (1), (2), (3), and (4) multiple times, to provide and maintain an updated production order tasklist file. For example, the macroscheduler server 120 can generate updated production order tasklist files on a predetermined schedule, such as every 15 minutes. This ensures that there is no more than a 15 minute delay between when a program file is modified and when the production order tasklist file reflects the modification. It also enables a developer to make changes or modifications to the program files and production order up until shortly before the production order is executed and the program files are downloaded to the EGM device.

The production order tasklist server 130 is configured to store the production order tasklist file generated by the macroscheduler server 120. In certain example embodiments, the production order tasklist server 130 uses a FileZilla FTP server service. The production order tasklist server 130 can also have dual redundancy.

The production download server 140 is configured to store the set of program files corresponding to the active production order, and that are included in the production order tasklist file. While the release server may store all available program files for download (and various versions of the available program files), the production download server may store only those program files that correspond to active production orders in various example embodiments. For example, a production order tasklist file includes a list of program files and their corresponding file paths on the release server. The production download server 140 may electronically communicate with the release server 110 to receive and store the program files corresponding to the active production order. Similar to the production order tasklist server 130, the production download server 140 can use a FileZilla FTP server service, and can have dual redundancy.

In various embodiments, the production network download ("PND") client tool 150 includes a device that plugs in to the EGM device to enable the EGM device to perform various functions. The PND client tool can act as a "key" that plugs in to the EGM device to enable the EGM device to perform the various functions. Without the PND client tool plugged in, the EGM device may not be able to access the appropriate servers to download the program files. However, when the PND client tool is plugged in, the EGM device (via information stored on the PND client tool 15) can access the servers and perform various other functions. In certain example embodiments, the PND client tool 150 includes a linux based software tool. In various embodiments, the PND client tool includes executable computerized instructions that enable the EGM device to: (1) initiate the download of program files; (2) access the appropriate server(s) to download the program files; (3) download the program files; and (4) install the downloaded program files. The PND client tool enables the EGM device to perform these functions by including embedded usernames and passwords for the various servers disclosed herein. In particular, the PND client tool includes embedded usernames and passwords for the production order tasklist server 130 and the production download server 140. The embedded usernames and passwords of the PND client tool 150 enable automatic authentication without the need for an operator to manually enter information to obtain authentication.

In various embodiments, the EGM device 160 is configured to perform various operations using the PND client tool 150. Specifically, the EGM device 160: (1) initiates the download of program files; (2) accessed the appropriate servers to download the program files; (3) downloads the program files; and (4) installs the downloaded program files.

Regarding function (1), the EGM device 160 is configured to initiate a download of program files based on input received via a user interface of the EGM device. An operator on the production floor may insert the PND client tool 150, and select an option to initiate the download of program files corresponding to a production order. The EGM device 160 then initiates the download by communicating with one or more of the servers 110, 120, 130, and 140 described herein.

Regarding function (2), the EGM device 160 is configured to access the appropriate servers using the PND client tool 150 (i.e., via the embedded usernames and passwords). In particular, the EGM device 160 accesses the production order tasklist server 130 to access the production order tasklist file. The EGM device then determines the appropriate program files to be downloaded (and their corresponding file paths) based on the production order tasklist file. The EGM device 160 then accesses the production download server 140.

Regarding function (3), the EGM device 160 is configured to then download the program files from the production download server 140. The EGM device 160 may be able to download only those program files that correspond to the production order, and may be prevented from downloading other program files. The downloaded program files are then stored by the EGM device 160.

Regarding function (4), the EGM device 160 is configured to then install the downloaded program files.

The EGM device 160 can also perform various functions other than those described above. Example EGM devices and their example corresponding components are discussed in further detail below with respect to FIGS. 3, 4A, and 4B.

Figure 2A:
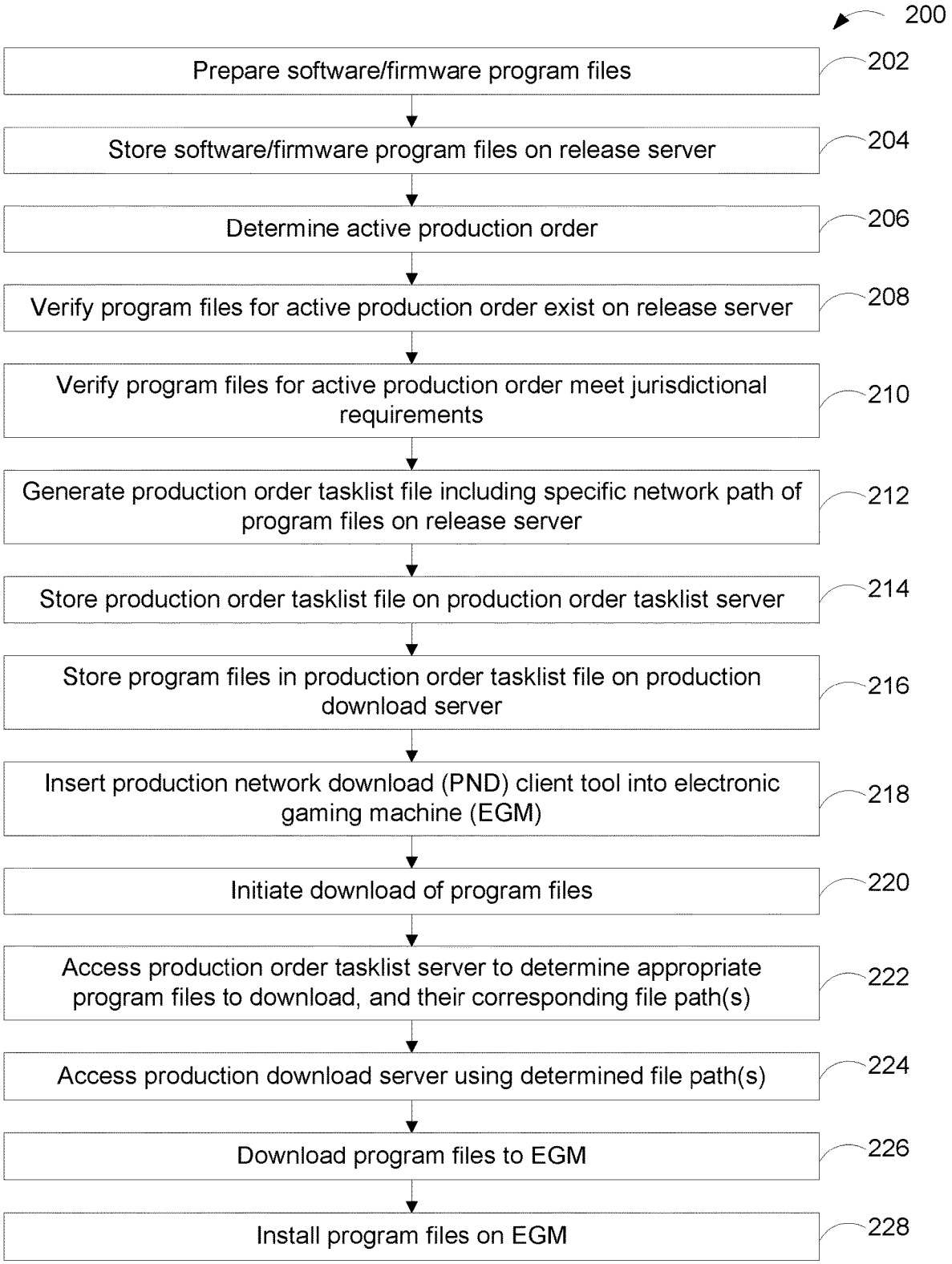
FIGS. 2A, 2B, and 2C are flowcharts illustrating example methods of the present disclosure.
Figure 2B:
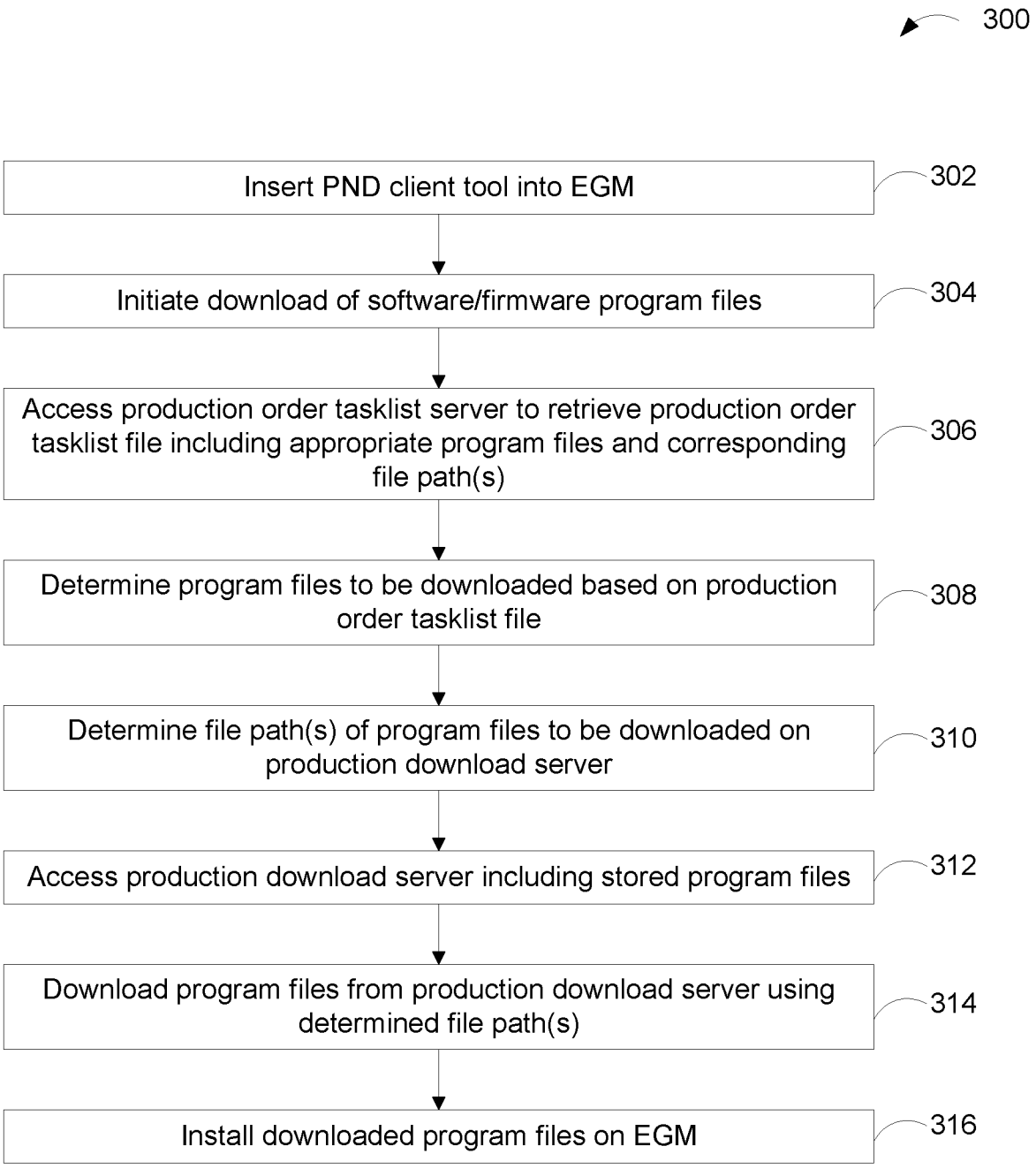
Figure 2C:
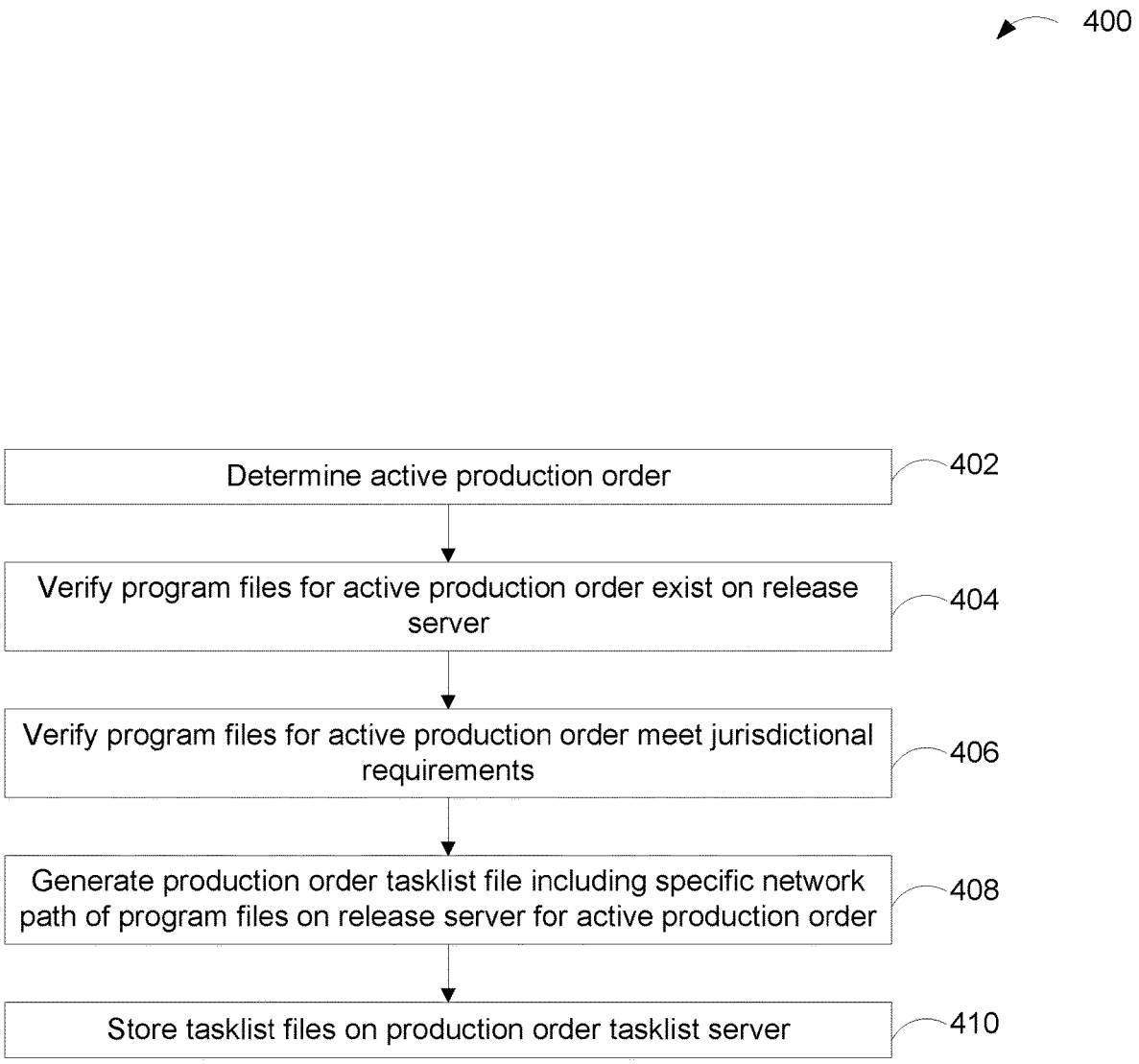

Referring now to FIGS. 2A, 2B, and 2C, example methods of the present disclosure are further described. More specifically, FIG. 2A illustrates a flowchart of an example method 200 of downloading electronic gaming machine program files to an EGM device that can be performed by the system of FIG. 1. FIG. 2B illustrates a flowchart of an example method 300 of downloading EGM program files to an EGM device that can be performed by the EGM device. FIG. 2C 400 illustrates an example method of generating a production order tasklist file that can be performed by the system of FIG. 1. In various embodiments, the methods 200, 300, and 400 are represented by a set of instructions stored in one or more memories and executed by one or more processors. Although the methods 200, 300, and 400 are described with reference to the flowcharts shown in FIGS. 2A, 2B, and 2C, many other methods of performing the acts associated with these illustrated methods may be employed. For example, the order of certain of the illustrated blocks may be changed, certain of the illustrated blocks may be optional, or certain of the illustrated blocks may not be employed.

Regarding FIG. 2A, example method 200 includes preparing software and/or firmware program files, as indicated by block 202. As noted above, a developer can use an update developer computing device to generate, create, develop, or otherwise prepare various program files for download to an EGM device.

The method 200 includes storing the program files on a release server, as indicated by block 204. The developer may access the release server via the update developer computing device to transmit the program files to the release server for storage.

The method 200 includes determining an active production order, as indicated by block 206. As noted above, an active production order includes a particular EGM device and a list of program files that should be downloaded to the EGM device. In some examples, the macroscheduler server can determine the active production order.

The method 200 includes verifying that program files for the active production order exist on the release server, as indicated by block 208. As noted above, this can be performed by the macroscheduler server. The macroscheduler server can transmit a query to the release server to determine whether the program files corresponding to the active production order are located at their corresponding file paths on the release server.

The method 200 includes verifying that the program files for the active production order meet their corresponding jurisdictional requirements, as indicated by block 210. As noted above, this can be performed by the macroscheduler server.

The method 200 includes generating a production order tasklist file including the specific network path of the program files included in the active production order (e.g., the program files to be downloaded to the EGM device), as indicated by block 212. The production order tasklist file can include the network paths of the program files on the release server.

The method 200 includes storing the production order tasklist file on the production order tasklist server, as indicated by block 214. As noted above, the production order tasklist file can be generated and/or updated at predetermined intervals, such as every 15 minutes. This enables the production order tasklist file to remain up to date including any recent changes.

The method 200 includes storing the program files corresponding to the production order tasklist file on the production download server, as indicated by block 216. This can include the production download server communicating with the release server to download the program files included in the production order tasklist file.

The method 200 includes inserting the PND client tool into the EGM device, as indicated by block 218. As noted above, the PND client tool includes a linux based software tool that includes executable computerized instructions that enable the EGM device to perform various functions.

The method 200 includes initiating a download of program files to the EGM device, as indicated by block 220.

The method 200 includes accessing the production order tasklist file to determine the appropriate program files to download, and their corresponding file paths, as indicated by block 222. As noted above, this can be performed by the EGM device. The EGM device accesses the production tasklist server using a username and password embedded in the PND client tool. The username and password can provide authentication of the EGM device, and then based on this authentication, the EGM device may be granted access. The EGM device can then determine the appropriate program files and corresponding file paths based on the stored production order tasklist file.

The method 200 includes accessing the production download server, as indicated by block 224. This can also be performed by the EGM device, and access may be granted based on authentication of the username and password embedded in the PND client tool.

The method 200 includes downloading the program files from the production order tasklist file using the file paths determined at block 222, as indicated by block 226.

The method 200 includes installing the downloaded program files on the EGM device, as indicated by block 228.

Regarding FIG. 2B, the method 300 is an example method for downloading EGM program files to an EGM device as performed by the EGM device. The method 300 includes inserting a PND client tool into an EGM device, as indicated by block 302. This may be similar or identical to block 218 of method 200.

The method 300 includes initiating a download of software and/or firmware program files, as indicated by block 304. This may be similar or identical to block 220 of method 200.

The method 300 includes accessing a production order tasklist server to retrieve a production order tasklist file including the appropriate program files and corresponding file paths, as indicated by block 306. This may be similar or identical to block 222 of method 200.

The method 300 includes determining the program files to be downloaded based on the production order tasklist file, as indicated by block 308.

The method 300 includes determining the file path(s) on the production download server of the program files to be downloaded to the EGM device, as indicated by block 310.

The method 300 includes accessing the production download server including the stored program files, as indicated by block 312. This may be similar or identical to block 224 of method 200.

The method 300 includes downloading the program files from the production download server, using the determined file path(s), as indicated by block 314. This may be similar or identical to block 226 of method 200.

The method 300 includes installing the downloaded program files on the EGM device, as indicated by block 316. This may be similar or identical to block 228 of method 200.

Regarding FIG. 2C, the method 400 is an example method for generating a production order tasklist file that can be performed by the system of FIG. 1. The method 400 includes determining an active production order, as indicated by block 402. This may be similar or identical to block 206 of method 200.

The method 400 includes verifying that the program files corresponding to the active production order exist on the release server, as indicated by block 404. This may be similar or identical to block 208 of method 200.

The method 400 includes verifying that the program files for the active production order meet corresponding jurisdictional requirements, as indicated by block 406. This may be similar or identical to bock 210 of method 200.

The method 400 includes generating a production order tasklist file including the specific network path on the release server of the program files for the active production order, as indicated by block 408. This may be similar or identical to block 212 of method 200.

The method 400 includes storing the generated production order tasklist file on the production order tasklist server, as indicated by block 410. This may be similar or identical to block 214 of method 200.

In one example embodiment, the EGM device includes an AVP box. In one example embodiment of the present disclosure, the following method can be employed to download firmware program files to the AVP box: (1) ensuring that the AVP box has IBDX* application boot and APT00001 authentication boot chip installed; (2) inserting the PND tool (e.g., PRDND0202) into the AVP box security USB port; (3) connecting an ethernet cable to the ethernet port of the AVP box; (4) connecting a barcode scanner to any USB port of the AVP box; (5) connecting a display to the AVP box display port or VGA port; (6) connecting a power cable to the AVP box and power on the AVP box; (7) establishing a DHCP IP address using the PND tool; (8) scanning the "boot download only" process barcode; (9) scanning the purchase order (PO #) barcode on MIS terminal (with the current PO #active on the MIS terminal); (10) automatically downloading and installing, via the PND tool, the PO #bill of materials (BOM)—IBR specified; (11) when the operation of step 10 is complete, displaying, using the PND tool, the installed IBR application BIOS—verifying that the displayed IBR application BIOS match the BOM; (12) turning off the power to the AVP box; (13) opening the AVP box lid and removing the APT00001 boot chip; (14) installing the APR boot chip (authentication processor released) per BOM; (15) removing the PND Tool, ethernet cable, barcode scanner, power cable and video cable; and (16) tagging the AVP box with a label to track the PND process.

In another example, the following method can be employed to download software program files to an AVP box: (1) inserting the PND tool (e.g., PRDND0202) into the AVP box security USB port; (2) connecting an ethernet cable to the ethernet port of the AVP box; (3) connecting a barcode scanner to any USB port of the AVP box; (4) connecting a local USB storage drive to any USB port; (5) turning the power on and booting the EGM corresponding to the AVP box—such that the PND tool is displayed; (6) establishing a DHCP IP address using the PND tool; (7) scanning the "packages download only" process barcode; (8) scanning the purchase order (PO #) barcode on MIS terminal or PO #barcode on EGM (with the current PO #active on the MIS terminal); (9) automatically downloading and installing, via the PND tool, the PO #BOM (e.g., IO020, AI020, GI020, AB020 and other associated Ascent packages as specified); (10) when the operation of step 9 is complete, displaying, using the PND tool, the installed packages—verify that the displayed packages match the BOM; (11) removing the PND tool, ethernet cable, barcode scanner, power cable and local USB storage drive; and (12) tagging the AVP box with a label to track the PND process.

As noted above, the system and methods disclosed herein provide various benefits to the process of downloading production order specific software and/or firmware to EGM devices. The example system 100 and methods 200, 300, and 400 provide improvements to: (1) quality; (2) process; and (3) security.

The quality improvements include more uniformity in execution of production orders, which ensures that each customer receives the highest quality product. Furthermore, the software and/or firmware updates performed using the disclosed system and methods require less human work hours, thereby reducing the likelihood of human error. In addition, the disclosed system and methods ensure that only specific software and/or firmware program files can be downloaded to an EGM device based on the production order, thereby reducing the likelihood that incorrect software and/or firmware is downloaded.

The process improvements provided by the disclosed systems and methods include eliminating work hours needed to retrieve and return physical devices used in known systems and methods. The USB flash drives used in known systems are no longer needed, thereby reducing time needed by operators to find the correct USB flash drive and return it after completing execution of the production order. The disclosed system and methods also eliminate the delay caused by not having a particular program file for a production order available on a USB flash drive. By centrally storing all the program files, they are all accessible to the EGM device if included in the production order. Furthermore, the disclosed systems and methods provide a significant improvement to the process of implementing changes to program files for software and/or firmware updates. Known systems and methods require that a new USB flash drive be loaded with an updated program file, and that the operator retrieve the updated program file on the USB flash drive. The disclosed system and methods instead perform a rolling update of the program files, which are then immediately accessible for download by the EGM devices. The EGM device can then access the updated program files immediately after they are updated, without the need for an operator to retrieve a new USB flash drive including the updated program file.

The security improvements provided by the disclosed systems and methods include that the electronic security of the servers used can be greater than that of the USB flash drives, thereby providing increased security of the entire system. The disclosed system and methods also removes the risks associated with the used of USB flash drives, including that the proprietary program files on the USB flash drives may no longer be tampered with, corrupted, misplaced, or intentionally stolen.

Various other benefits and improvements will be apparent from the disclosed example system and methods.

Gaming Systems

The above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. A "gaming system" as used herein refers to various configurations of: (a) one or more central servers, central controllers, or remote hosts; and (b) one or more electronic gaming machines such as those located on a casino floor.

Thus, in various embodiments, the gaming system of the present disclosure includes: (a) one or more electronic gaming machines in combination with one or more central servers, central controllers, or remote hosts; (b) a single electronic gaming machine; (c) a plurality of electronic gaming machines in combination with one another; (d) a single central server, central controller, or remote host; and/or (e) a plurality of central servers, central controllers, or remote hosts in combination with one another.

For brevity and clarity and unless specifically stated otherwise, the term "EGM" is used herein to refer to an electronic gaming machine (such as a slot machine, a video poker machine, a video lottery terminal (VLT), a video keno machine, or a video bingo machine located on a casino floor). Additionally, for brevity and clarity and unless specifically stated otherwise, "EGM" as used herein represents one EGM or in certain instances a plurality of EGMs, and "central server, central controller, or remote host" as used herein represents one central server, central controller, or remote host or a plurality of central servers, central controllers, or remote hosts.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system includes a plurality of EGMs that are each configured to communicate with a central server, a central controller, and/or a remote host through a data network.

In certain embodiments in which the gaming system includes an EGM in combination with a central server, central controller, or remote host, the central server, central controller, or remote host is any suitable computing device (such as a server) that includes at least one processor and at least one memory device or data storage device. As further described herein, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. One, more than one, or each of the functions of the central server, central controller, or remote host may be performed by the at least one processor of the EGM. Further, one, more than one, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. In certain embodiments in which the data network is a WAN, the gaming system includes a central server, central controller, or remote host and an EGM each located in a different gaming establishment in a same geographic area, such as a same city or a same state. Gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet (such as the Internet) or an intranet. In certain such embodiments, an Internet browser of the EGM is usable to access an Internet game page from any location where an Internet connection is available. In one such embodiment, after the EGM accesses the Internet game page, the central server, central controller, or remote host identifies a player before enabling that player to place any wagers on any plays of any wagering games. In one example, the central server, central controller, or remote host identifies the player by requiring a player account of the player to be logged into via an input of a unique username and password combination assigned to the player. The central server, central controller, or remote host may, however, identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the Internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server."

The central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 3:
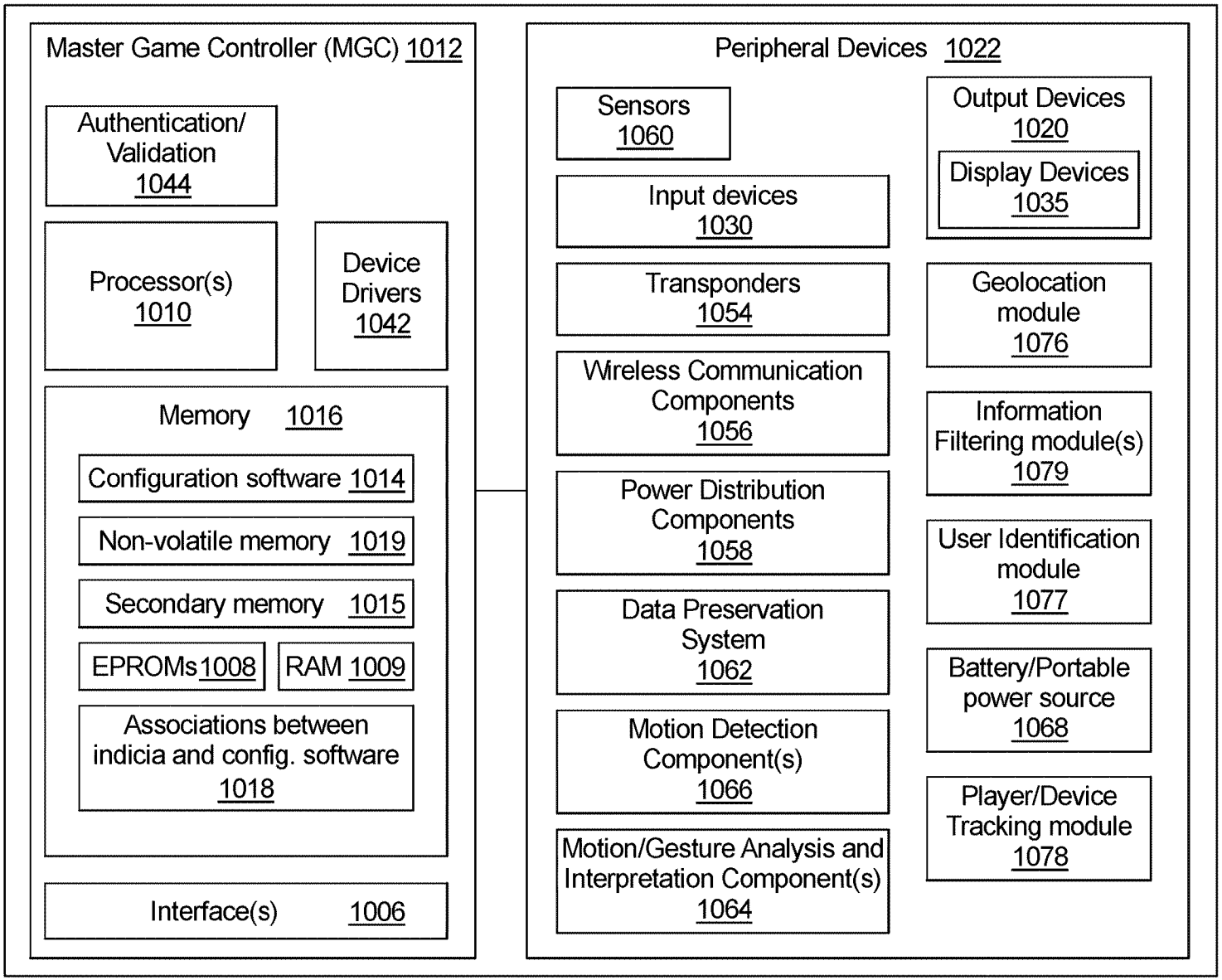
FIG. 3 is a schematic block diagram of one example embodiment of an electronic gaming machine of the example system of FIG. 1.
Figure 4A:
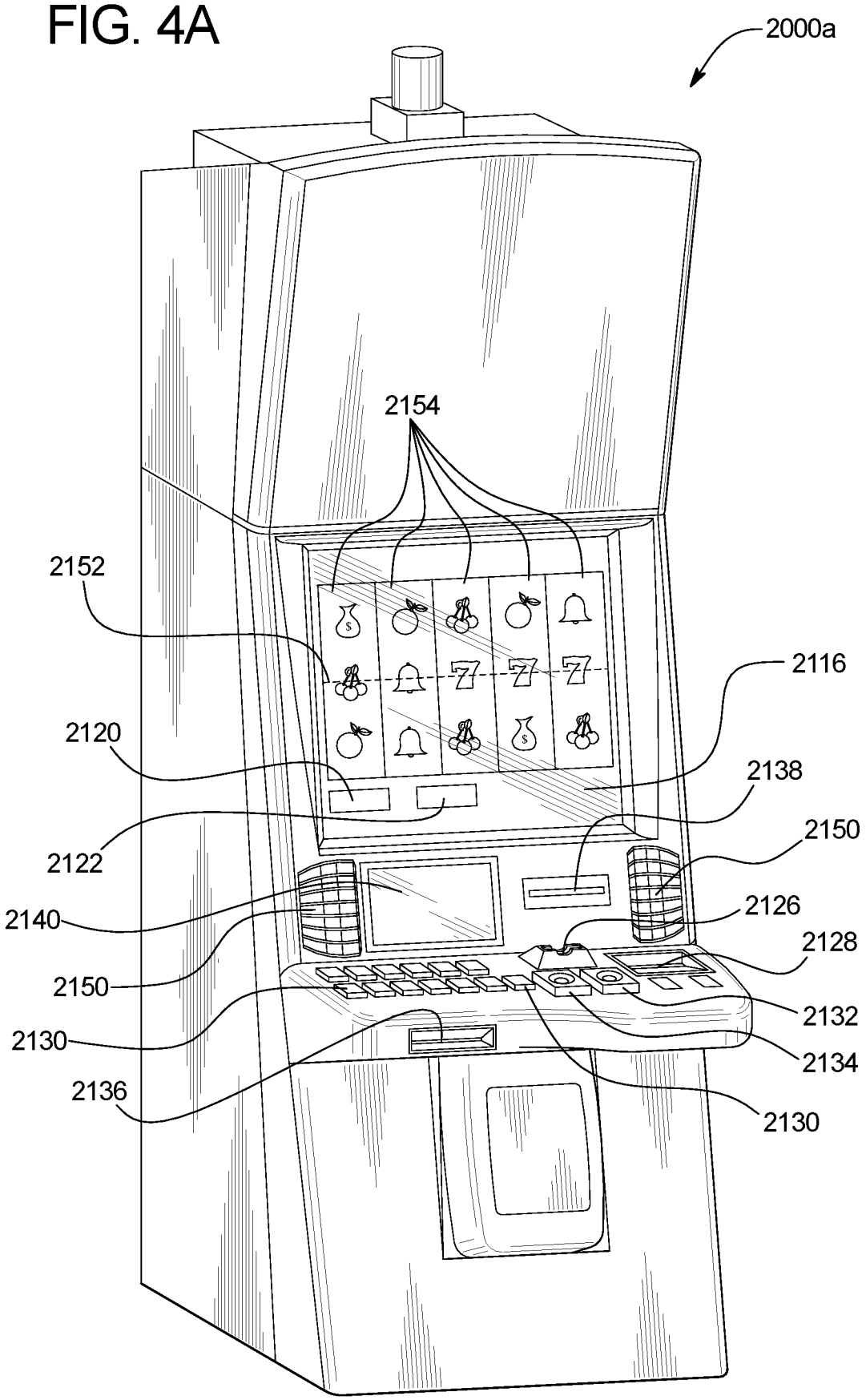
FIGS. 4A and 4B are perspective views of example alternative embodiments of an electronic gaming machine of the gaming system disclosed herein.
Figure 4B:
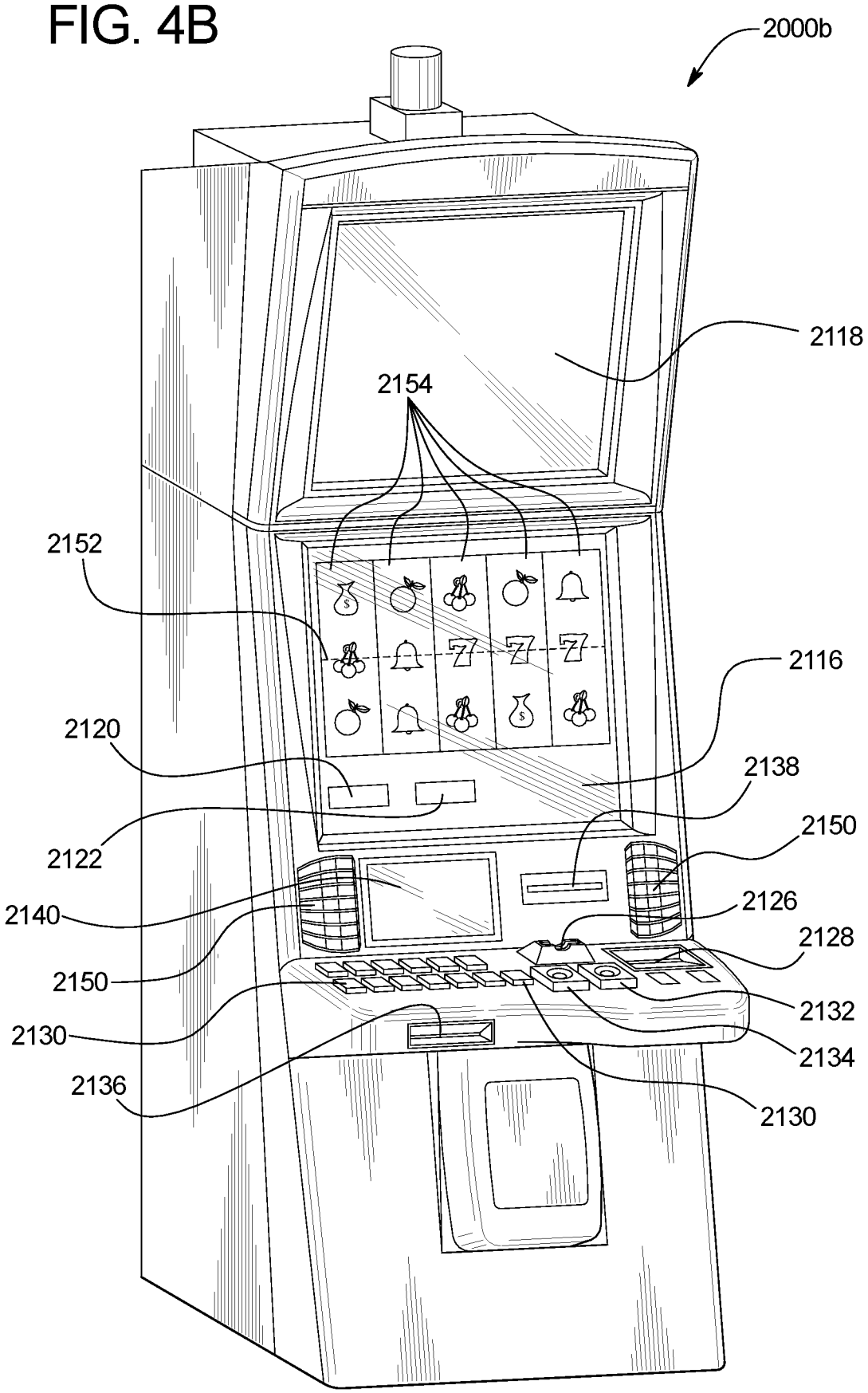

FIG. 3 is a block diagram of an example EGM 1000 and FIGS. 4A and 4B include two different example EGMs 2000*a* and 2000*b*. The EGMs 1000, 2000*a*, and 2000*b* are merely example EGMs, and different EGMs may be implemented using different combinations of the components shown in the EGMs 1000, 2000*a*, and 2000*b*.

In these embodiments, the EGM 1000 includes a master gaming controller 1012 configured to communicate with and to operate with a plurality of peripheral devices 1022.

The master gaming controller 1012 includes at least one processor 1010. The at least one processor 1010 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface 1006 of the master gaming controller 1012; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices 1022 (such as input/output devices); and/or (5) controlling the peripheral devices 1022. In certain embodiments, one or more components of the master gaming controller 1012 (such as the at least one processor 1010) reside within a housing of the EGM (described below), while in other embodiments at least one component of the master gaming controller 1012 resides outside of the housing of the EGM.

The master gaming controller 1012 also includes at least one memory device 1016, which includes: (1) volatile memory (e.g., RAM 1009, which can include non-volatile RAM, magnetic RAM, ferroelectric RAM, and any other suitable forms); (2) non-volatile memory 1019 (e.g., disk memory, FLASH memory, EPROMs, EEPROMs, memristor-based non-volatile solid-state memory, etc.); (3) unalterable memory (e.g., EPROMs 1008); (4) read-only memory; and/or (5) a secondary memory storage device 1015, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device 1016 resides within the housing of the EGM (described below), while in other embodiments at least one component of the at least one memory device 1016 resides outside of the housing of the EGM. In these embodiments, any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

The at least one memory device 1016 is configured to store, for example: (1) configuration software 1014, such as all the parameters and settings for a game playable on the EGM; (2) associations 1018 between configuration indicia read from an EGM with one or more parameters and settings; (3) communication protocols configured to enable the at least one processor 1010 to communicate with the peripheral devices 1022; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller 1012 communicates with other devices using a serial communication protocol. A few non-limiting examples of serial communication protocols that other devices, such as peripherals (e.g., a bill validator or a ticket printer), may use to communicate with the master game controller 1012 include USB, RS-232, and Netplex (a proprietary protocol developed by IGT).

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

In certain embodiments, the at least one memory device 1016 is configured to store program code and instructions executable by the at least one processor of the EGM to control the EGM. The at least one memory device 1016 of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device 1016 also stores a plurality of device drivers 1042. Examples of different types of device drivers include device drivers for EGM components and device drivers for the peripheral components 1022. Typically, the device drivers 1042 utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™' near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device 1016 can be upgraded as needed. For instance, when the at least one memory device 1016 is a hard drive, new games, new game options, new parameters, new settings for existing parameters, new settings for new parameters, new device drivers, and new communication protocols can be uploaded to the at least one memory device 1016 from the master game controller 1012 or from some other external device. As another example, when the at least one memory device 1016 includes a CD/DVD drive including a CD/DVD configured to store game options, parameters, and settings, the software stored in the at least one memory device 1016 can be upgraded by replacing a first CD/DVD with a second CD/DVD. In yet another example, when the at least one memory device 1016 uses flash memory 1019 or EPROM 1008 units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In some embodiments, the at least one memory device 1016 also stores authentication and/or validation components 1044 configured to authenticate/validate specified EGM components and/or information, such as hardware components, software components, firmware components, peripheral device components, user input device components, information received from one or more user input devices, information stored in the at least one memory device 1016, etc. Examples of various authentication and/or validation components are described in U.S. Pat. No. 6,620,047, entitled "Electronic Gaming Apparatus Having Authentication Data Sets."

In certain embodiments, the peripheral devices 1022 include several device interfaces, such as: (1) at least one output device 1020 including at least one display device 1035; (2) at least one input device 1030 (which may include contact and/or non-contact interfaces); (3) at least one transponder 1054; (4) at least one wireless communication component 1056; (5) at least one wired/wireless power distribution component 1058; (6) at least one sensor 1060; (7) at least one data preservation component 1062; (8) at least one motion/gesture analysis and interpretation component 1064; (9) at least one motion detection component 1066; (10) at least one portable power source 1068; (11) at least one geolocation module 1076; (12) at least one user identification module 1077; (13) at least one player/device tracking module 1078; and (14) at least one information filtering module 1079.

The at least one output device 1020 includes at least one display device 1035 configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM 2000*a* illustrated in FIG. 4A includes a central display device 2116, a player tracking display 2140, a credit display 2120, and a bet display 2122. The example EGM 2000*b* illustrated in FIG. 4B includes a central display device 2116, an upper display device 2118, a player tracking display 2140, a credit display 2120, and a bet display 2122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device 1020 includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. The example EGMs 2000*a* and 2000*b* illustrated in FIGS. 4A and 4B each include a ticket printer and dispenser 2136. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket-Out Capability"; U.S. Pat. No. 7,275,991, entitled "Slot Machine with Ticket-In/Ticket-Out Capability"; and U.S. Pat. No. 6,048,269, entitled "Coinless Slot Machine System and Method."

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine."

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device 1020 is a sound generating device controlled by one or more sound cards. In one such embodiment, the sound generating device includes one or more speakers or other sound generating hardware and/or software configured to generate sounds, such as by playing music for any games or by playing music for other modes of the EGM, such as an attract mode. The example EGMs 2000*a* and 2000*b* illustrated in FIGS. 4A and 4B each include a plurality of speakers 2150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device 1030 may include any suitable device that enables an input signal to be produced and received by the at least one processor 1010 of the EGM.

In one embodiment, the at least one input device 1030 includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. The example EGMs 2000*a* and 2000*b* illustrated in FIGS. 4A and 4B each include a combined bill and ticket acceptor 2128 and a coin slot 2126.

In one embodiment, the at least one input device 1030 includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device 1030 includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device 1030 includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. The example EGMs 2000*a* and 2000*b* illustrated in FIGS. 4A and 4B each include a game play activation device in the form of a game play initiation button 2132. In other embodiments, the EGM begins game play automatically upon appropriate funding rather than upon utilization of the game play activation device.

In other embodiments, the at least one input device 1030 includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance. The example EGMs 2000*a* and 2000*b* illustrated in FIGS. 4A and 4B each include a cashout device in the form of a cashout button 2134.

In various embodiments, the at least one input device 1030 includes a plurality of buttons that are programmable by the EGM operator to, when actuated, cause the EGM to perform particular functions. For instance, such buttons may be hard keys, programmable soft keys, or icons icon displayed on a display device of the EGM (described below) that are actuatable via a touch screen of the EGM (described below) or via use of a suitable input device of the EGM (such as a mouse or a joystick). The example EGMs 2000*a* and 2000*b* illustrated in FIGS. 4A and 4B each include a plurality of such buttons 2130.

In certain embodiments, the at least one input device 1030 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device 1030 includes a card reader in communication with the at least one processor of the EGM. The example EGMs 2000*a* and 2000*b* illustrated in FIGS. 4A and 4B each include a card reader 2138. The card reader is configured to read a player identification card inserted into the card reader.

The at least one wireless communication component 1056 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 1056 transmits electrical, electromagnetic, or optical signals that carry digital data streams or analog signals representing various types of information.

The at least one wired/wireless power distribution component 1058 includes components or devices that are configured to provide power to other devices. For example, in one embodiment, the at least one power distribution component 1058 includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component 1058 is configured to distribute power to one or more internal components of the EGM, such as one or more rechargeable power sources (e.g., rechargeable batteries) located at the EGM.

In certain embodiments, the at least one sensor 1060 includes at least one of: optical sensors, pressure sensors, RF sensors, infrared sensors, image sensors, thermal sensors, and biometric sensors. The at least one sensor 1060 may be used for a variety of functions, such as: detecting movements and/or gestures of various objects within a predetermined proximity to the EGM; detecting the presence and/or identity of various persons (e.g., players, casino employees, etc.), devices (e.g., user input devices), and/or systems within a predetermined proximity to the EGM.

The at least one data preservation component 1062 is configured to detect or sense one or more events and/or conditions that, for example, may result in damage to the EGM and/or that may result in loss of information associated with the EGM. Additionally, the data preservation system 1062 may be operable to initiate one or more appropriate action(s) in response to the detection of such events/conditions.

The at least one motion/gesture analysis and interpretation component 1064 is configured to analyze and/or interpret information relating to detected player movements and/or gestures to determine appropriate player input information relating to the detected player movements and/or gestures. For example, in one embodiment, the at least one motion/gesture analysis and interpretation component 1064 is configured to perform one or more of the following functions: analyze the detected gross motion or gestures of a player; interpret the player's motion or gestures (e.g., in the context of a casino game being played) to identify instructions or input from the player; utilize the interpreted instructions/ input to advance the game state; etc. In other embodiments, at least a portion of these additional functions may be implemented at a remote system or device.

The at least one portable power source 1068 enables the EGM to operate in a mobile environment. For example, in one embodiment, the EGM 300 includes one or more rechargeable batteries.

The at least one geolocation module 1076 is configured to acquire geolocation information from one or more remote sources and use the acquired geolocation information to determine information relating to a relative and/or absolute position of the EGM. For example, in one implementation, the at least one geolocation module 1076 is configured to receive GPS signal information for use in determining the position or location of the EGM. In another implementation, the at least one geolocation module 1076 is configured to receive multiple wireless signals from multiple remote devices (e.g., EGMs, servers, wireless access points, etc.) and use the signal information to compute position/location information relating to the position or location of the EGM.

The at least one user identification module 1077 is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module 1079 is configured to perform filtering (e.g., based on specified criteria) of selected information to be displayed at one or more displays 1035 of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

As generally described above, in certain embodiments, such as the example EGMs 2000*a* and 2000*b* illustrated in FIGS. 4A and 4B, the EGM has a support structure, housing, or cabinet that provides support for a plurality of the input devices and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs 2000*a* and 2000*b* shown in FIGS. 4A and 4B, EGMs may have varying housing and display configurations.

In certain embodiments, the EGM is a device that has obtained approval from a regulatory gaming commission, and in other embodiments, the EGM is a device that has not obtained approval from a regulatory gaming commission.

The EGMs described above are merely three examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

In various embodiments, an EGM may be implemented in one of a variety of different configurations. In various embodiments, the EGM may be implemented as one of: (a) a dedicated EGM in which computerized game programs executable by the EGM for controlling any primary or base games (referred to herein as "primary games") and/or any secondary or bonus games or other functions (referred to herein as "secondary games") displayed by the EGM are provided with the EGM before delivery to a gaming establishment or before being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat. No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the gaming system includes one or more executable game programs executable by at least one processor of the gaming system to provide one or more primary games and one or more secondary games. The primary game(s) and the secondary game(s) may include any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM **2000*b* shown in FIG. 4B includes a payline 1152 and a plurality of reels 1154**. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations."

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. Examples of progressive gaming systems are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the gaming system provides credits or other awards for one or more plays of one or more secondary games. The secondary game typically enables an award to be obtained in addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, period of time) being exceeded, or based on a specified number of points being earned during game play. Any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a mobile phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No. 7,617,151, entitled "Alternative Player Tracking Techniques"; and U.S. Pat. No. 8,057,298, entitled "Virtual Player Tracking and Related Services."

Social Network Integration

In certain embodiments, the gaming system is configured to communicate with a social network server that hosts or partially hosts a social networking website via a data network (such as the Internet) to integrate a player's gaming experience with the player's social networking account. This enables the gaming system to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the gaming system to receive certain information from the social network server, such as the player's likes or dislikes or the player's list of connections. In certain embodiments, the gaming system enables the player to link the player's player account to the player's social networking account(s). This enables the gaming system to, once it identifies the player and initiates a gaming session (such as via the player logging in to a website (or an application) on the player's personal gaming device or via the player inserting the player's player tracking card into an EGM), link that gaming session to the player's social networking account(s). In other embodiments, the gaming system enables the player to link the player's social networking account(s) to individual gaming sessions when desired by providing the required login information.

For instance, in one embodiment, if a player wins a particular award (e.g., a progressive award or a jackpot award) or an award that exceeds a certain threshold (e.g., an award exceeding $1,000), the gaming system sends information about the award to the social network server to enable the server to create associated content (such as a screenshot of the outcome and associated award) and to post that content to the player's wall (or other suitable area) of the social networking website for the player's connections to see (and to entice them to play). In another embodiment, if a player joins a multiplayer game and there is another seat available, the gaming system sends that information to the social network server to enable the server to create associated content (such as text indicating a vacancy for that particular game) and to post that content to the player's wall (or other suitable area) of the social networking website for the player's connections to see (and to entice them to fill the vacancy). In another embodiment, if the player consents, the gaming system sends advertisement information or offer information to the social network server to enable the social network server to create associated content (such as text or an image reflecting an advertisement and/or an offer) and to post that content to the player's wall (or other suitable area) of the social networking website for the player's connections to see. In another embodiment, the gaming system enables the player to recommend a game to the player's connections by posting a recommendation to the player's wall (or other suitable area) of the social networking website.

Differentiating Certain Gaming Systems from General Purpose Computing Devices Certain of the gaming systems described herein, such as EGMs located in a casino or another gaming establishment, include certain components and/or are configured to operate in certain manners that differentiate these systems from general purpose computing devices, i.e., certain personal gaming devices such as desktop computers and laptop computers.

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are not state-based machines, and a majority of data is usually lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just before the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum period of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just before when the malfunction occurred. The restored state may include metering information and graphical information that was displayed on the EGM in the state before the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just before the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM before, during, and/or after the disputed game to demonstrate whether the player was correct or not in the player's assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents in a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

Various changes and modifications to the present embodiments described herein will be apparent to those skilled in the art. Such changes and modifications can be made without departing from the spirit and scope of the present subject matter and without diminishing its intended technical scope. It is therefore intended that such changes and modifications be covered by the appended claims.

What is claimed is:

1. A method of downloading electronic gaming machine program files to an electronic gaming machine device, said method comprising:

accessing an order tasklist file corresponding to an active order associated with the electronic gaming machine device;

determining a set of electronic gaming machine program files to be downloaded to the electronic gaming machine device based on the order tasklist file, the set of electronic gaming machine program files comprising one of software and firmware;

determining that the set of electronic gaming machine program files adhere to jurisdictional requirements corresponding to a location in which the electronic gaming machine device is expected to operate;

determining a file path of the set of electronic gaming machine program files; and physically inserting a network download client tool, separate from the electronic gaming machine device, into the electronic gaming machine device, to enable the electronic gaming machine device to:

access a username and a password stored on the network download client tool;

access the set of electronic gaming machine program files from a remote server based on the determined file path and after a verification using the username and password;

download the set of electronic gaming machine program files from the remote server; and install the set of electronic gaming machine program files on the electronic gaming machine device.

2. The method of claim 1, comprising verifying that the set of the electronic gaming machine program files exist, and generating the order tasklist file comprising a list of the set of electronic gaming machine program files and corresponding file path.

3. The method of claim 2, comprising generating updated order tasklist files on a predetermined schedule.

4. The method of claim 1, wherein accessing the set of electronic gaming machine program files based on the determined file path comprises authenticating using the username and the password, and based on the authentication, downloading the set of electronic gaming machine program files.

5. The method of claim 1, wherein accessing the order tasklist file comprises authenticating using the username and the password, and based on the authentication, retrieving the order tasklist file corresponding to the active order associated with the electronic gaming machine device.

6. A method of downloading electronic gaming machine program files to an electronic gaming machine device, said method comprising:

physically receiving a network download client tool that is separate from the electronic gaming machine device and that is inserted into the electronic gaming machine device, the network download client tool storing a username and a password;

after a verification using the username and password, using the network download client tool to access an order tasklist server to retrieve an order tasklist file corresponding to an active order associated with the electronic gaming machine device;

determining a set of electronic gaming machine program files to be downloaded to the electronic gaming machine device based on the order tasklist file, the set of electronic gaming machine program files comprising one of software and firmware;

determining that the set of electronic gaming machine program files adhere to jurisdictional requirements corresponding to a location in which the electronic gaming machine device is expected to operate;

determining a file path of the set of electronic gaming machine program files;

accessing the set of electronic gaming machine program files based on the determined file path;

downloading the set of electronic gaming machine program files; and installing the set of electronic gaming machine program files.

7. The method of claim 6, which comprises verifying that the set of the electronic gaming machine program files exist on a release server, and generating the order tasklist file comprising a list of the set of electronic gaming machine program files and corresponding file path.

8. The method of claim 7, which comprises storing the order tasklist file on the order tasklist server.

9. The method of claim 7, which comprises generating updated order tasklist files on a predetermined schedule.

10. The method of claim 6, which comprises downloading the set of electronic gaming machine program files from a download server.

11. The method of claim 10, wherein accessing the set of electronic gaming machine program files based on the determined file path comprises authenticating the network download client tool via the username and the password, and based on the authentication, downloading the set of electronic gaming machine program files from the download server.

12. The method of claim 11, wherein using the network download client tool to access the order tasklist server comprises authenticating the network download client tool via the user-name and the password, and based on the authentication, retrieving the order tasklist file corresponding to the active order associated with the gaming device.

13. A network download client tool for and separate from an electronic gaming machine device, the network download client tool comprising:

a housing configured to be physically inserted into and connected to the electronic gaming machine device; and a memory device supported by the housing and storing a username, a password, and a set of the electronic gaming machine program files to be downloaded to the electronic gaming machine device based on an order tasklist file, the set of electronic gaming machine program files comprising one of software and firmware, the set of electronic gaming machine program files adhering to jurisdictional requirements corresponding to a location in which the electronic gaming machine device is expected to operate, wherein after the housing is physically inserted into and connected to the electronic gaming machine device, the electronic gaming machine device can first use the username and password to verify the set of electronic gaming machine program files, and after a verification, based on the username and password, of the set of electronic gaming machine program files, access the set of electronic gaming machine program files based on a determined file path and download electronic gaming machine program files to the electronic gaming machine device.

14. The network download client tool of claim 13, wherein an update developer computing device is configured to generate the electronic gaming machine program files and transmit the electronic gaming machine program files to a release server prior to being downloaded on the memory device.

15. The network download client tool of claim 13, wherein a macroscheduler server is configured to transmit the order tasklist file to an order tasklist server prior to the electronic gaming machine program files being downloaded on the memory device.

16. The network download client tool of claim 15, wherein the macroscheduler server is configured to generate updated order tasklist files on a predetermined schedule.

17. The network download client tool of claim 13, wherein a download server is configured to store the set of electronic gaming machine program files corresponding to an active order.

18. The network download client tool of claim 17, which is configured to enable the electronic gaming machine device to download the set of electronic gaming machine program files corresponding to the active order from the download server.

19. The network download client tool of claim 18, wherein the network download client tool comprises software comprising the username and the password granting access to the download server.

20. The network download client tool of claim 13, wherein the network download client tool comprises software comprising the username and the password granting access to the order tasklist server.

* * * * *